US007999701B1

(12) United States Patent
Xu et al.

(10) Patent No.: US 7,999,701 B1
(45) Date of Patent: Aug. 16, 2011

(54) TRANSPORTATION NOTIFICATION SYSTEM

(76) Inventors: Bin Xu, Erie, PA (US); Shiwen Wang, Creve Coeur, MO (US)

( * ) Notice: Subject to any disclaimer, the term of this patent is extended or adjusted under 35 U.S.C. 154(b) by 441 days.

(21) Appl. No.: 12/215,274

(22) Filed: Jun. 26, 2008

(51) Int. Cl.
*G08G 1/123* (2006.01)

(52) U.S. Cl. ..... 340/994; 340/993

(58) Field of Classification Search ..... 340/994, 340/993
See application file for complete search history.

(56) References Cited

U.S. PATENT DOCUMENTS

| | | | | |
|---|---|---|---|---|
| 4,325,057 | A | 4/1982 | Bishop | |
| 6,184,802 | B1 * | 2/2001 | Lamb | 340/994 |
| 6,700,506 | B1 | 3/2004 | Winkler et al. | |
| 6,748,318 | B1 * | 6/2004 | Jones | 701/201 |
| 2003/0137435 | A1 * | 7/2003 | Haddad et al. | 340/994 |
| 2005/0131625 | A1 * | 6/2005 | Birger et al. | 701/117 |
| 2005/0258980 | A1 * | 11/2005 | Conover | 340/994 |
| 2006/0164259 | A1 * | 7/2006 | Winkler et al. | 340/944 |
| 2007/0103313 | A1 * | 5/2007 | Washington | 340/572.8 |
| 2008/0158016 | A1 * | 7/2008 | Wang et al. | 340/993 |

* cited by examiner

*Primary Examiner* — Travis R Hunnings
(74) *Attorney, Agent, or Firm* — Vincent G. LoTempio; Douglas Smith; Brendan Lillis

(57) ABSTRACT

The present invention relates to a system and method of providing students, drivers, guardians, and schools with useful notifications regarding a school's transportation system comprising, at least one vehicle for transporting people as passengers; a transceiver unit within a vehicle comprising a wireless communication means, a satellite navigation system receiver to acquire the location of the vehicle, a memory storage device for storing map and vehicle route information, at least one display means for presenting information to a vehicle driver, and a Central Processing Unit (CPU) interfaced to the memory storage device, to the wireless communication means, and to the satellite navigation system receiver, wherein the transceiver unit transfers data regarding a location of the at least one vehicle relative to a plurality of passenger pick-up and drop-off locations; a plurality of household units located proximate to the pick-up and drop-off locations comprising at a means for sending and receiving data regarding passenger status and the vehicles' impending arrival at the pick-up and drop-off locations, a display means, and a CPU controllably interfaced to the means for sending and receiving data and to the display means.

13 Claims, 10 Drawing Sheets

TRANSPORTATION NOTIFICATION SYSTEM

BACKGROUND OF THE INVENTION

1. Field of the Invention

The present invention relates to a system and method for notifying interested parties at a remote location of a current location and status of a vehicle, for notifying vehicle drivers of changes to their routes, and for providing vehicle fleet operators with detailed information on their vehicle fleet. More specifically, the present invention relates to a notification system that will provide a guardian or care giver advance notice of an approaching bus or of potential delays, that will provide bus drivers with notice of students who do not wish to be picked up, or are not present to be dropped off on a given day, and finally that will provide a school with detailed information about the routes, fuel consumption, and other data from their vehicle fleet.

2. Background

In many municipalities, school systems are required to provide children with transportation to and from school. Generally, this transportation is in the form of busing, where school buses pick up and deliver children along several bus routes. This system has a number of shortcomings. For instance, the arrival time of buses often varies due to traffic, inclement weather, and other delays. This inconveniences students who must ordinarily leave their homes well in advance of the actual arrival time of a bus. Guardians are inconvenienced as well, since they must awake earlier than necessary when they are unaware that the bus is going to be delayed. Similarly, guardians do not know exactly when a bus will arrive with their children in the afternoon, and if their children have arrived safely at home or at school.

In addition to students and guardians, the bus drivers and school system also lack important information such as which students do not desire to be picked up on a given day. Accordingly, bus drivers may unnecessarily pass by, or even wait at a bus stop when the students assigned to that stop do not plan to use the bus on that day.

In addition, the school system lacks a way to quickly assess the security, safety and status of their bus fleet. For instance, schools lack the ability to obtain current information regarding the position, speed, of their buses and status of the occupants while the bus is en route or afterwards.

Several devices and methods have been invented to notify a potential passenger of the impending arrival of a vehicle. For example, U.S. Pat. No. 4,325,057 to Bishop discloses a bus notification system wherein each bus transmitter emits a signal at a unique radio frequency to identify a specific bus. Each receiver is then tuned to the frequency corresponding to the bus transmitter and the length of time between notification and bus arrival is determined by adjusting the receiver's sensitivity. When the receiver acquires the bus transmission above the predetermined sensitivity threshold the notification system is activated. In this disclosure, the distance of the arriving bus is determined by the strength of the radio signal received from the bus. However, this system is limited in accuracy, and is prone to premature notifications. Obstructions in the wireless radio frequency path can reduce the signal strength thereby tricking the distance calculation by the receiver. Premature notification can arise if the bus route includes several streets that are in close proximity requiring the bus to double back to cover the streets.

U.S. Pat. No. 6,700,506 issued to Winkler, discloses a vehicle arrival system that enables passengers to know the precise arrival time of the transporting vehicle several minutes before its arrival. This system achieves its superior accuracy by using the Global Positioning System (GPS) as a means of estimating the position of a vehicle. Also, the system detects vehicle direction and speed which are used in conjunction with the vehicle's position to determine whether the vehicle has arrived at a specified stop. However, this system is limited in several ways. For instance, a passenger cannot use this system to notify a bus driver that he or she does not wish to be picked up. Accordingly, a bus driver will be forced to make unnecessary stops, wasting time and fuel, and putting unnecessary wear and tear on the bus. Also, users of this system can only receive notifications if they are nearby a receiving unit. Furthermore, the system does not provide a way for a guardian to determine if their child has arrived home safely. Additionally, the system does not provide for real time monitoring of a vehicle fleet. Finally, the system does not utilize in place communication networks such as the Internet or telephone networks.

Thus it is readily apparent that there is a long felt need for a robust transportation notification system which utilizes existing, cost effective, and widely deployed communication infrastructure including land line telephone networks, mobile telephone networks, and the Internet. Furthermore, there is a need for transportation notification system that alerts guardians if and when their children arrived home, enables passengers to easily notify vehicle drivers when they do not wish to be picked up, provides drivers with useful information including which passengers are to be picked up, and provides the fleet operator with useful fleet data.

SUMMARY OF THE INVENTION

The present invention generally comprises a vehicle arrival and tracking system which provides useful notifications and information to interested parties such as students being picked up on a bus route, to vehicle drivers, and also to the school or other organization that is in control of the vehicle fleet. This invention notifies students and their guardians when a school bus is nearing arrival in the morning. The invention also provides notifications to students and their guardians of delays resulting from traffic, accidents, or other causes. Additionally, the invention notifies guardians when their children have been dropped off. The invention further provides a means for students to notify their bus driver that they do not wish to be picked up on a given day. Finally, the invention provides the school with detailed data regarding their entire bus fleet.

The system includes a Main Units installed on each School bus (MUS). Each MUS is a wireless transceiver unit containing a satellite navigation system receiver, a central processing unit (CPU), a passenger status display, and wireless transceiver devices such as mobile telephone communication modules. The MUS's monitor the location of a bus, and wirelessly transmit several notifications. The notifications alert interested parties to events such as the impending arrival of a bus, of traffic delays, and of accidents and mechanical breakdowns. Additionally, the MUS's acquire, interpret, transmit, and log vehicle data which may include of speed, direction, position, fuel consumption. Also, the MUS's receive incoming notifications from passengers when they do not wish to be picked up, and alert bus drivers to this information via the passenger status display. Finally, the MUS's record the arrival and departure of passengers from a bus.

Additionally, another embodiment includes household units located in guardians' homes. The household units notify students and their guardians of an arriving bus and of delays, and also provide a means for students to notify the bus driver that they do not wish to be picked up on a given day. Also, the household unit can notify a guardian who is not home by calling the guardian's telephone. The household units are capable of receiving and sending data from the MUS's through a connection to a landline telephone network.

Another embodiment of the invention includes a worldwide web service (web service). The web service receives and integrates the various data acquired by the MUSs located on each vehicle so that notifications can be sent to interested parties through the Internet, and fleet information can optionally be displayed at the location of the web server, or remotely.

Another embodiment includes portable handheld units to be carried by passengers. The handheld units provide notifications to students and are utilized in conjunction with the MUS to record when students enter and depart from a bus. Like a household unit, a handheld unit provides notifications to a student about an arriving bus, and also of delays and accidents. One embodiment of the present invention is a transportation notification system comprising at least one vehicle for transporting people as passengers, a transceiver unit within the vehicle including a wireless communication means, a satellite navigation system receiver to acquire the location of a vehicle, a memory storage device for storing map and vehicle route information, at least one display for presenting information to a vehicle driver, and at least one Central Processing Unit (CPU) interfaced to the memory storage device, to the wireless communication means, and to the satellite navigation system receiver, wherein the transceiver unit transfers data regarding a location of the at least one vehicle relative to a plurality of passenger pick-up and drop-off locations; a plurality of household units located proximate to the pick-up and drop-off locations comprising at least one means for sending and receiving data regarding passenger status and the vehicles' impending arrival at the pick-up and drop-off locations, at least one display means, and at least one CPU controllably interfaced to the means for sending and receiving data and to the display means.

It is accordingly a primary object of the present invention to provide a real-time, easy to use service to guardians to inform of an approaching school bus.

Another object of the invention is to notify guardians when their children have arrived home.

Yet another object of the invention is to notify the driver of which passengers are to be picked up and dropped off each day.

A further object of the invention is to alert guardians when their children have arrived home from school.

Another further object of the invention is to provide a cost effective means of notification by using existing widely deployed telephone networks.

Another further object of the invention is to provide a system and method of tracking a bus with virtually unlimited range by utilizing robust preexisting communications infrastructure which is already deployed nationally and/or worldwide such as land based telephone networks, mobile telephone networks, and the Internet.

Another further object of the invention is ensure compliance with Federal Communication Commission (FCC) guidelines by utilizing existing FCC compliant communications infrastructure such as land based telephone networks, mobile telephone networks, and the Internet.

Still another object of the invention is to provide additional cost savings by utilizing caller identification technology to interpret the meaning of various notifications sent over a telephone network. In this way, calls do not need to be answered, and call time is not accrued.

Another object of the invention is to provide a vehicle tracking system which is expandable in order to accommodate additional vehicle occupants or cargo by providing for expansion slots where additional mobile telephone or other communication modules can be added to the system.

Another object of the invention is to provide additional cost savings by utilizing the order in which calls are received from a telephone number or numbers to determine the meaning of the call.

Another further object of the invention is to provide a way to send and receive transportation notifications from an Internet connected device such as a personal computer or Internet enabled mobile telephone.

Another object of the invention is to provide the school or other operator of a vehicle fleet with detailed real time information on each vehicle.

Another object of the invention is to provide passengers with an easy way to notify a bus driver when they do not wish to be picked up.

Additional objects and advantages will become apparent and a more thorough and comprehensive understanding may be had from the following description and claims taken in conjunction with the accompanying drawings forming a part of this specification.

BRIEF DESCRIPTION OF THE DRAWINGS

The present invention and the manner in which it may be practiced is further illustrated with reference to the accompanying drawings wherein:

FIG. 4(*b*) is a schematic diagram of the household unit.

FIG. 4(*c*) is a schematic diagram of the handheld unit.

FIG. 6(*b*) is a flowchart to facilitate the functionality of the Main Unit in the School bus (MUS) during the drop off of students.

DETAILED DESCRIPTION OF THE INVENTION

Figure 1:
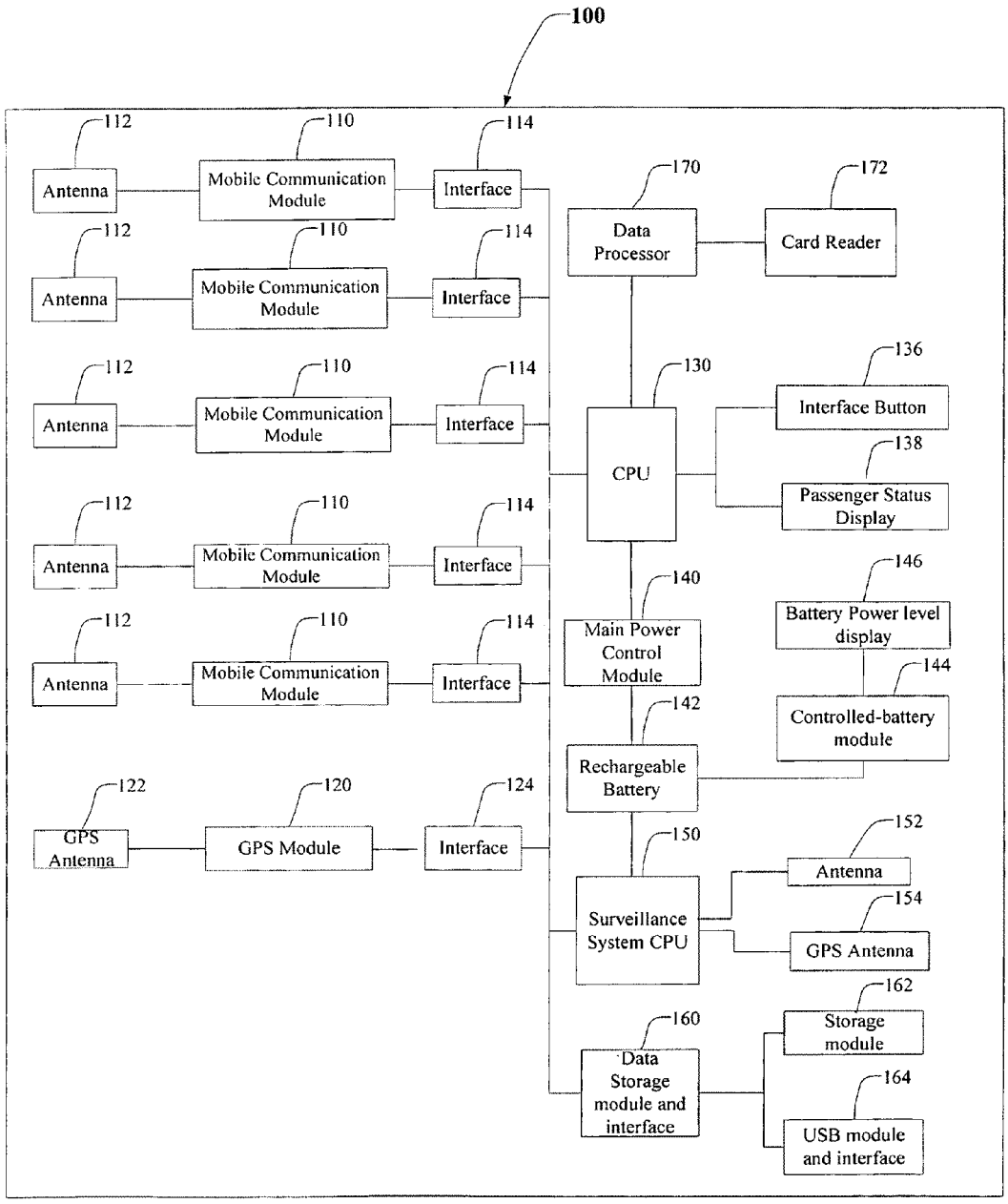
FIG. 1 is a block diagram of the Main Unit on the School bus (MUS).

At the outset, it should be clearly understood that like reference numerals are intended to identify the same structural elements, portions, or surfaces consistently throughout the several drawing Figures, as may be further described or explained by the entire written specification of which this detailed description is an integral part. The drawings are intended to be read together with the specification and are to be construed as a portion of the entire "written description" of this invention as required by 35 U.S.C. §112.

FIG. 1 is a block diagram 100 showing the components of Main Units installed on each School bus (MUS 101). Each MUS is a transceiver unit containing at least one wireless communication means, a satellite navigation receiver, a Central Processing Unit (CPU), a power supply, and a means for displaying information to a bus driver.

Each MUS utilizes a wireless communication means in order to send notifications and other data regarding vehicle location, passenger status, and vehicle status to other components of the invention such as the household units, handheld units, and to the web service. Additionally, each MUS utilizes a wireless communication means to receive notifications, such as those originating from the household units to indicate that a student is not to be picked up on a given day. Any type of suitable wireless communication means may be used. However, in the preferred embodiment, the MUS's utilize a mobile telephone network for this purpose. While any variety of mobile telephone network may be used, the preferred embodiment utilizes a mobile telephone network conforming to the presently popular Global System for Mobile communications (GSM) standard. The GSM standard is appealing because it has available a mobile data service for transferring digitally encoded data known as the General Packet Radio Service (GPRS) and also supports text messaging through the Short Message Service (SMS). While the MUS does not require a mobile data service in all embodiments of the present invention, such functionality is desirable, and is utilized in our preferred embodiment of the MUS to transfer data to the school. Accordingly, not all embodiments of the present invention require text messaging functionality, but our preferred embodiment utilizes this feature to send optional text messages to users of the system.

In the preferred embodiment, the mobile telephone functionality is realized with mobile communication modules 110 and mobile communication antennas 112. The term mobile communication module is used to simply refer to the electronic circuitry used to implement the sending and receiving of calls through a single telephone number on the GSM or other mobile telephone network. One or more mobile communication modules 110 may also contain circuitry to implement further functions, such as calling number identification, data transfer though the GPRS mobile data service, and the transfer of text messages through the Short Message Service (SMS). While the mobile communication modules 110 may be implemented in many ways, the preferred embodiment comprises a GSM transmission module and an associated power converter, and a microcontroller and its associated power converter.

Figure 6:
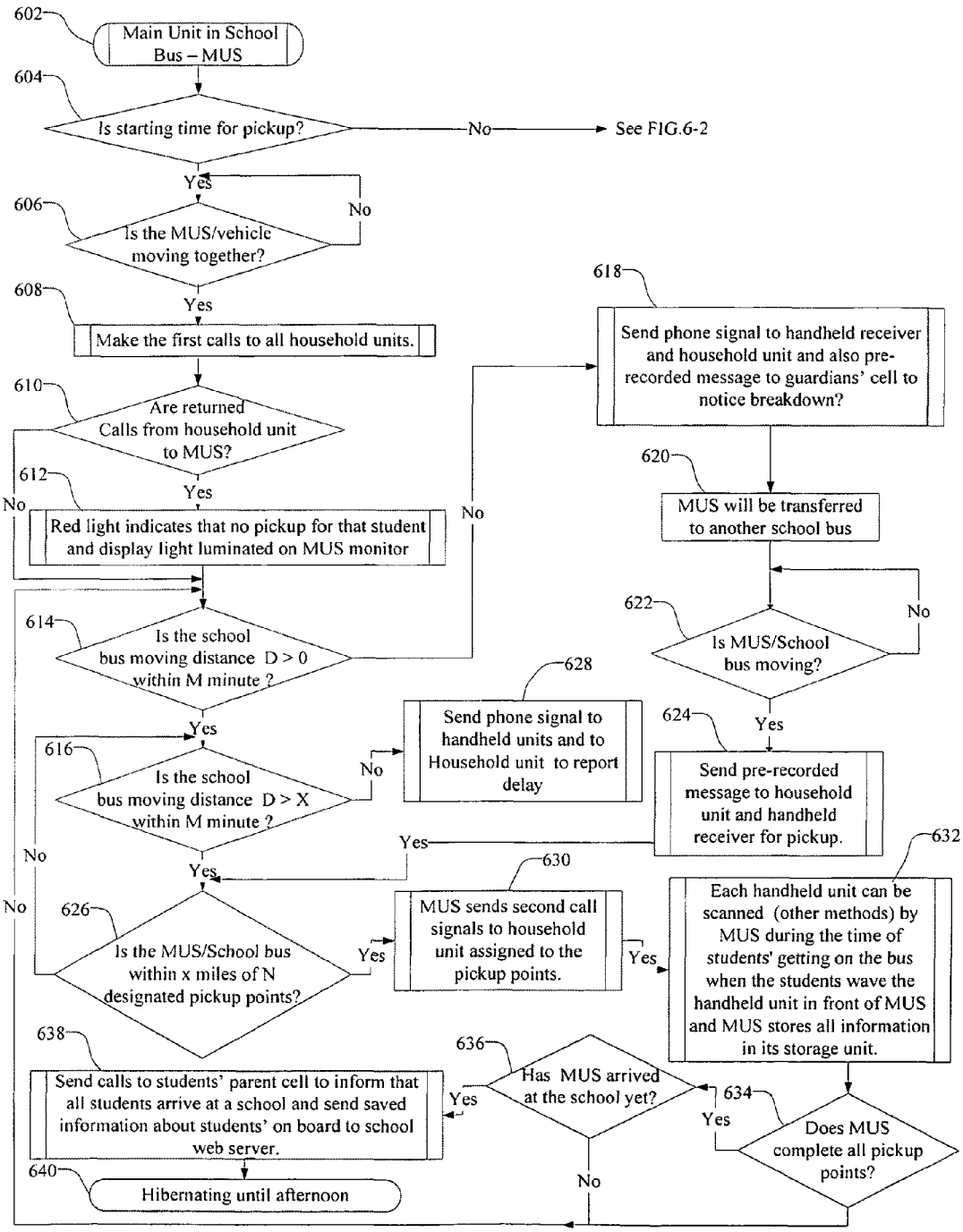
FIG. 6(*a*) is a flowchart to facilitate the functionality of the Main Unit in the School bus (MUS) during activation and during the pickup of students.
Figure 6:
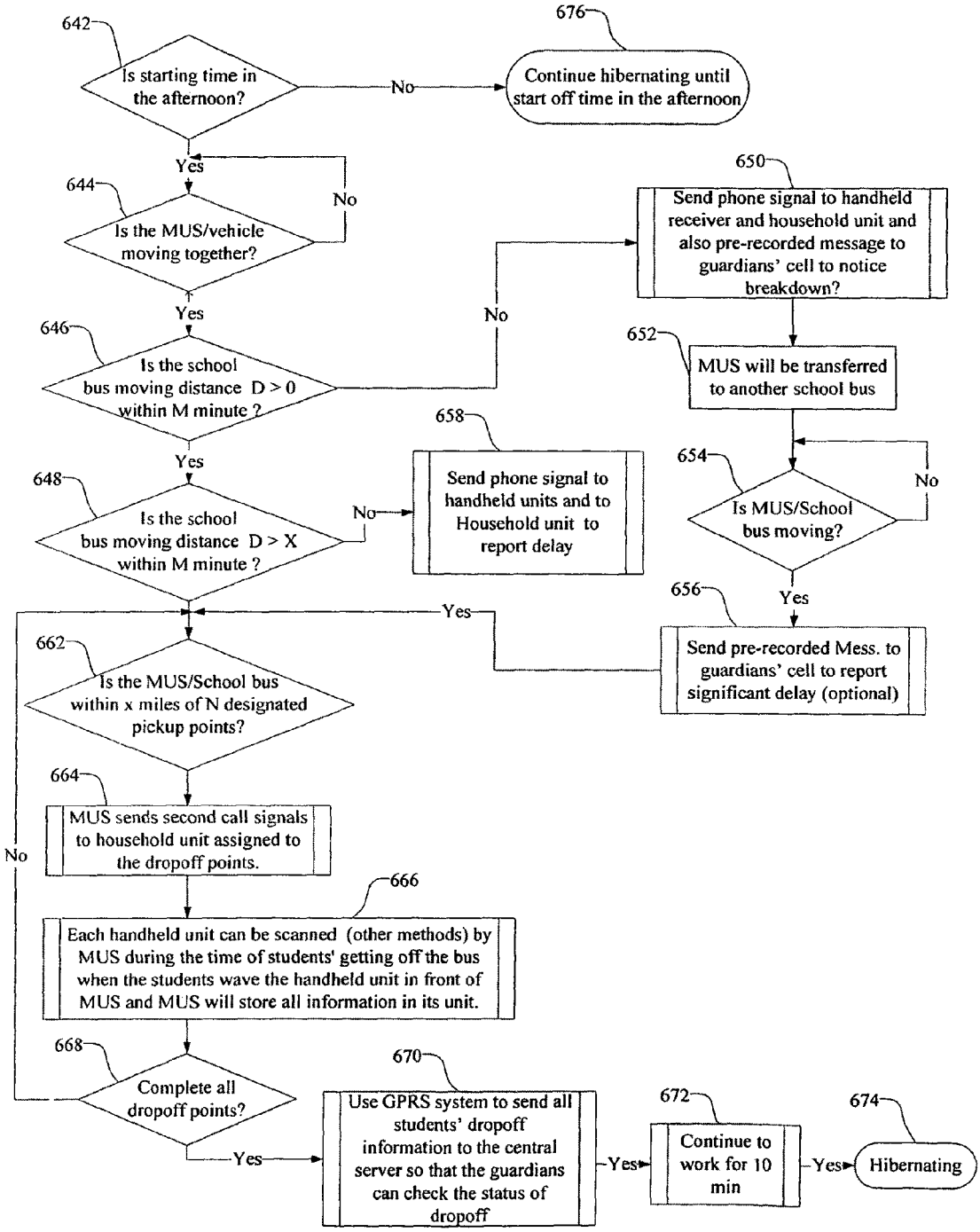

As the preferred embodiment is configured to utilize a GSM mobile phone network, several practical design considerations have been taken into account to ensure that that the MUS functions effectively with this type of network. One limitation that is considered is the time required to make a call through a GSM telephone network, which has been found to be approximately six seconds or less. As a typical bus may carry up to approximately 30 students, many notifications may need to be sent through GSM on a single trip. For instance, a separate notification for each student assigned to a bus may need to be made when a bus has departed from the school to pick up the students. In this situation, the MUS calls phone numbers assigned to the household units associated with each student when the bus leaves the school to pick up students, as shown in FIG. 6(*a*) and explained in the description thereof. In a worst case scenario this may require 180 seconds of call time. In order to speed up this calling process, several mobile communication modules 110 have been used in the preferred embodiment, wherein each module can operate simultaneously. In this way, the time required to make several calls can be decreased to a desired maximum amount of time by installing an appropriate number of GSM modules in the MUS's. For instance, the MUS in a bus holding 15 students may need to make 15 calls when the bus departs. If the MUS utilizes a single communication module to make the needed calls, and each call takes 6 seconds to complete, a total of 1.5 minutes are needed to complete the calls. However, if the MUS utilizes three mobile communication modules, three calls can be made simultaneously, and the total time needed to make the 15 calls is reduced to 30 seconds. In some embodiments of the present invention, the mobile communication modules 110 are removable, so that a MUS may be configured for use with any number of students.

Another design factor considered in the present invention is the cost incurred through usage of a mobile telephone network. To this end, the preferred embodiment of the present invention sends and receives most notifications without incurring call time by utilizing calling number identification. In the preferred embodiment, mobile phone notifications such as those indicating traffic are recognized by the receiving device by using call number identification. In our preferred embodiment, two mobile communication modules 110 are designated for this purpose.

Furthermore, many of the more frequently used notifications, such as notifications that a bus has left for pickup and that a bus is nearing arrival are sent through the same phone number or numbers. The device receiving the calls, which may be the MUS, household unit, or handheld unit, presumes the meaning of the notification in the present call by combining calling number identification with various additional information. This additional information may include the timeframe in which the call was received (for instance, morning versus afternoon), and how many calls were previously received from a given phone number within the present day or timeframe. This process is described more thoroughly in FIG. 6(*a*) and FIG. 6(*b*), and the descriptions thereof. In our preferred embodiment, such notifications are sent via three mobile communication modules 110 designated for this purpose.

Each MUS contains a passenger status display 138 for notifying the bus driver of which students are to be picked up on a given day. In the preferred embodiment, the display is located on front panel of the MUS and comprises an array of indicators which can be illuminated red or green. Each indicator is associated with a single student who is assigned to the bus in which the MUS is located. The operation of the display is described in detail in the discussion of FIG. 6(*a*).

Each MUS contains a satellite navigation system receiver to acquire the position of the each bus. The satellite navigation system receiver detects a wireless signal from one or more satellites though antenna 122 and derives the position of the MUS therefrom. The present invention can utilize any many different navigation systems, such the Global Positioning System (GPS), the Galileo positioning system, or the Global Navigation System (GLONASS). However, our preferred embodiment utilizes the GPS system. Each MUS contains a GPS module 120. The term GPS module refers to any variety of circuitry that can determine the bus location from the wireless signals originating from GPS satellites. In our preferred embodiment, the GPS module contains a receiver module which connects to an antenna 122, a microcontroller, and a power converter.

One purpose of the MUSs is to determine how far the bus is from several destinations, such as a school, student drop off points, and student pickup points. To this end, each MUS further contains a storage module 162. The storage module contains map and bus route data from which the CPU 130 can determine the distance that the bus must travel from its current position to a destination along a given route.

Another object of the MUSs is to generate of a log of entries and departures from a school bus. To do so, each MUS contains a card reader 172 such as an Identification (ID) scanner to record a student's entry or departure from the school bus. The ID scanner can be a magnetic card reader, an RFID (Radio Frequency Identification) reader, an optical barcode reader, a magnetic barcode reader, a radio frequency receiver, or any other appropriate device. The ID scanner records a unique identification code from a student's handheld unit, identification card, or other identification device during entry and/or departure. The data code or codes generated by the ID Scanner are processed by data processor 170 and sent to CPU 130.

Each MUS may be powered in a number of ways. In the preferred embodiment, Each MUS receives its power primarily through the electrical system of the bus in which it is located. Since the power supply from the bus may be intermittent at times, such as when the bus starts and when the engine is not running, each MUS of the preferred embodiment further comprises an internal rechargeable battery 142 which is electronically managed by controlled-battery module 144. A battery power level display 146 notifies the driver of the status of the rechargeable battery 142. The MUS further contains a main power control module 140 which contains a connector for receiving power from an external power supply. The power module 140 further contains any circuitry as may be needed to convert the power received through the previously mentioned connector to appropriate voltages needed to power the components within the MUS.

In the preferred embodiment, a USB module and interface 164 provides a convenient way of connecting an MUS to a computer or other device in order to access and/or change settings and download data to an MUS. For instance, the USB module and interface 164 may be used to download updated map information to an MUS. It also may be used to change the telephone numbers that the MUS calls to send notifications to the household units and other subsystems.

Figure 5:
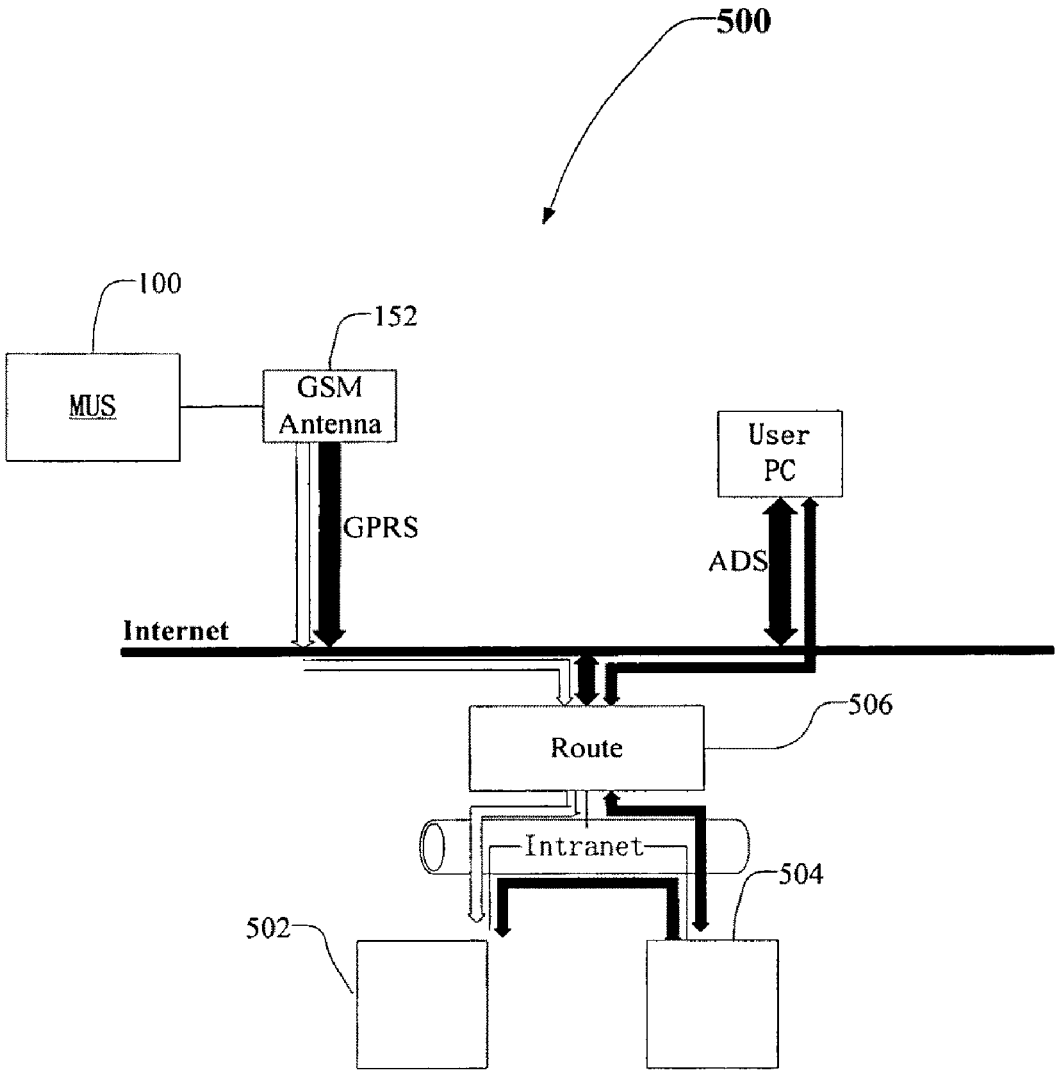
FIG. 5 is schematic diagram of the worldwide web service.

The MUS further contains a CPU 130 which controls the various components of the MUS through interfaces 114, 124, and data storage module and interface 160 through the connections shown. The interfaces contain a data bus and any additional circuitry to establish a data link between the various devices in the MUS and the CPU. The CPU further implements a process for the pickup of students as shown in FIG. 6 (*a*) and the description thereof, and a process for the drop-off of students as shown in FIG. 6 (*b*) and described in the description thereof. The MUS is further capable of streaming various data to the web service 500 as shown in FIG. 5 via the General Packet Radio Service (GPRS). In this way, the location of each vehicle in the fleet, data regarding the presence of passengers or cargo, vehicle fuel levels, and any other desired data can be received and analyzed in a central location. This is functionality carried out with the surveillance system 150, GSM antenna 152, and GPS antenna 154. Surveillance system CPU 150, contains a CPU for processing various data to be streamed to the web service, a GSM module to enable data to be streamed via GPRS, and a GPS receiver to acquire the position of the vehicle in which the MUS is located. To enable wireless transmission and reception, the surveillance system is additionally coupled to a GSM antenna 152 and a GPS antenna 154. While the surveillance system 150 in the preferred embodiment is a standalone unit with its own CPU, GSM module, and GPS module, it should be noted that the same functionality may be implemented in a variety of other ways in other embodiments. For instance, CPU 130 may be used in conjunction with a Mobile Communication Module 110, antenna 112, GPS module 120, and GPS antenna 122 to provide the same functionality. In this way, the number of system components would be reduced.

Figure 4A:
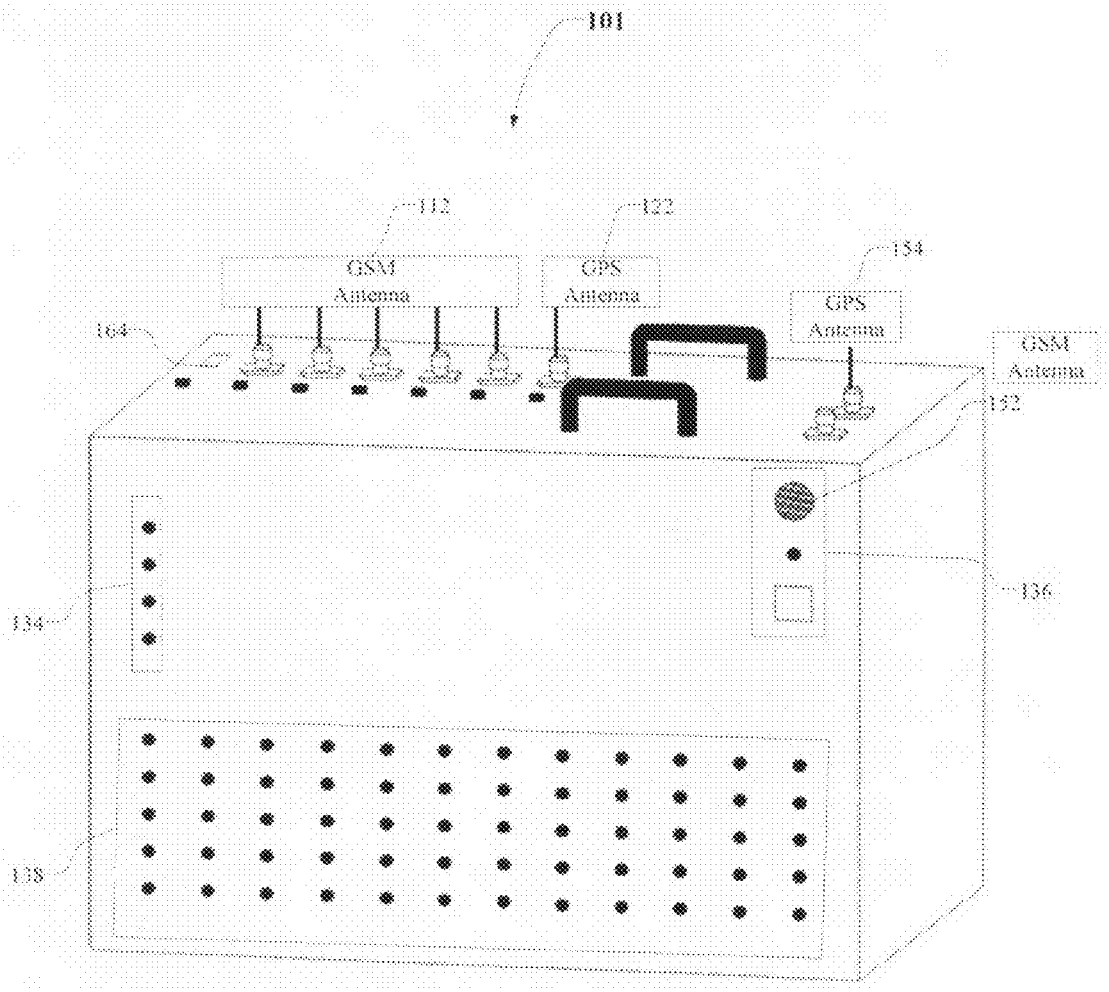
FIG. 4(*a*) is a schematic diagram of the main unit on the school bus.
Figure 4B:
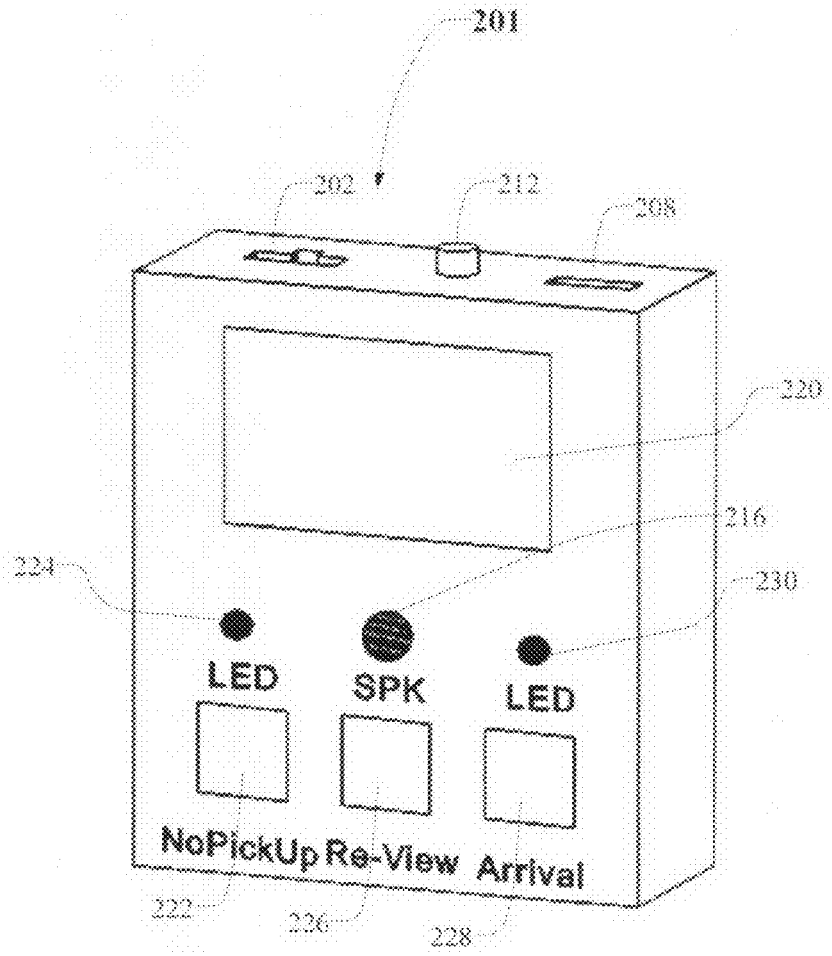
Figure 4C:
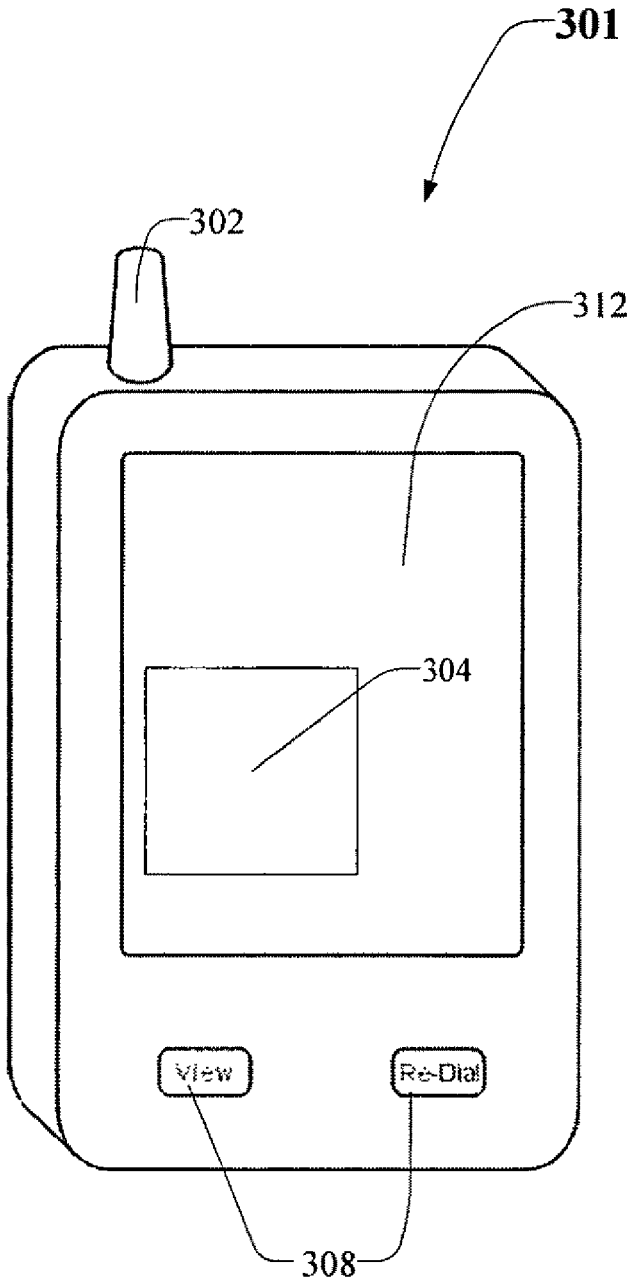

The MUSs can be made in various shapes and sizes, and placement of the displays, connectors, and other components thereon may vary. However, one embodiment of an MUS 101 is schematically illustrated in FIG. 4(*a*). In this embodiment, the front panel of the MUS contains several displays to be viewed by the bus driver. As indicated elsewhere herein, a passenger status display 138 is located on the front panel of the MUS for notifying a bus driver of which students are to be picked up on a given day. The operation of the display is described in detail in the discussion of FIG. 6(*a*). Additionally, a battery power level display 134 is located on the left-hand side of the front panel to indicate the power level of the rechargeable battery within the MUS. Finally, a problem reset interface button 136 is located on the right-hand side of the front panel. Depressing interface button 136 causes the MUS to send notifications to students, guardians, and other interested parties that the bus is resuming pickup or drop-off of students after a mechanical breakdown has been resolved. The display on the problem reset interface displays informational messages to alert the driver when the bus is experiencing mechanical malfunctions. Also shown in FIG. 4(*a*) are antennas 112 for the mobile communication modules 110 of FIG. 1, GSM antenna 152 for surveillance system 150 of FIG. 1, GPS antenna 122 for GPS module 120 of FIG. 1, and GPS antenna 154 for the surveillance system 150 of FIG. 1. The connector portion of the USB module 164 is located on the top panel of the MUS.

FIG. 6 depicts a flowchart to facilitate the functionality of the Main Unit in the School Bus (MUS) in our preferred embodiment during activation and during the pickup of students. Each bus in a fleet contains a separate MUS, and the purpose of the MUS is to provide guardians, students, and the bus driver with several useful notifications. Specifically, the MUS notifies a bus driver of which students are to be picked up or dropped off on a given day. Additionally, the MUS notifies students and guardians when a bus is nearing arrival and when the bus is delayed due to traffic, breakdowns, or for other reasons. Finally, the MUS streams various data wirelessly to a central server in the school.

In step 602, the MUS is activated. Activation may be accomplished in a number of ways. For example, in one embodiment, the MUS is activated when the engine of the vehicle in which the MUS is located is started. In other embodiments, the MUS may be activated manually by means of a switch that can be depressed by the bus driver. In another embodiment, activation initiates a wireless data link between MUS 101 and web service 500, in which real time data is continuously streamed from the MUS to the web service. In another preferred embodiment, data is continuously streamed to the web service via the General Packet Radio Service (GPRS) while the MUS remains active. The data includes the location of the bus and the names of the students present on the bus, the fuel level and/or a status flag to indicate mechanical failures.

Once activation is complete, the MUS proceeds to step 604. In step 604, the MUS queries the current time to determine whether it is presently the morning or afternoon. If it is morning, the MUS assumes that the bus will be picking up children and delivering them to the school, and proceeds to step 606. If it is not morning, the MUS proceeds to step 644 of FIG. 6(*b*).

If it is morning, step 606 will commence. In this step, the MUS continually queries GPS data to determine if the MUS unit is in motion. If so, the MUS and bus are presumed to be moving together. Motion of the MUS provides an indication that the bus has departed to begin pickup. When motion is detected, the MUS continues to step 608.

In steps 608, 610, and 612 the MUS determines which students are to be picked up on the present morning and presents this information to the driver. In step 608, the MUS makes calls via a mobile telephone network to the household units 201 associated with each student assigned to the bus route. The calls alert each household unit to reply to the MUS with a notification of whether the student or students associated with that household unit desire to be picked up on the present morning. The mobile telephone network may be used in a number of ways to signal the household unit. However, in the preferred embodiment, the MUS makes a telephone call to each household unit, and the household unit does not answer the call. In this way, call time minutes are not accrued on the mobile telephone account associated with the MUS and household unit. Additionally, the telephone call is made on a designated telephone number. The household units are configured to associate the "first call" from this number on a given day with a query to determine if the student(s) associated with the household unit wish to be picked up. In step 610, the MUS determines if any calls have been received from the household units. A received call from a household unit indicates that the no pickup button 222 on that household unit has been activated, and thus the students associated with that household unit do not wish to be picked up on the present day. If no call is received the system assumes a pickup and proceeds to step 612. In step 612, the MUS updates the passenger status display 138 as shown on FIG. 4(*a*) accordingly to indicate to the bus driver which students are to picked up that morning, and which students do not need to be picked up. Many types of displays can perform this function. In the preferred embodiment, display 138 is placed on the MUS front panel and comprises an array of indicators which can be illuminated red or green. Each indicator is associated with a single student who is assigned to the bus in which the MUS is located. If the MUS has received a call from a household unit indicating that the student from that household unit does not wish to be picked up, then the indicator associated with that student is set to "red." Otherwise, the indicator will be set to "green." Once step 612 is complete, the MUS proceeds to step 614.

In steps 614, 616, 618, 620, 622, 624, and 626, the MUS determines if and why the bus is going to incur a delay, and sends appropriate notifications to guardians, students, and the school. A substantial delay may result from traffic, an accident, or a mechanical breakdown. In our preferred embodiment, the MUS automatically determines whether the bus will be substantially delayed by analyzing the motion of the bus, and additionally assesses the most likely cause of the delay. In the preferred embodiment, the MUS in step 614 queries the distance which the bus has traveled in the past M minutes. If the distance traveled in the past M minutes is very close to or equal to 0, the bus has not been moving, and the source of the delay is most likely an accident or mechanical breakdown. Accordingly, the MUS will presume that a substantial delay will be incurred due to an accident or breakdown. If so, the MUS proceeds to Step 618 and sends notifications to the household units and handheld units to report that the bus will be delayed due to an accident or breakdown. In the preferred embodiment, the MUS signal is in the form of text messages transmitted through a mobile telephone network. A message may also be sent to guardians' mobile telephones via text messaging, a recorded audio message, or otherwise. In the case of an accident, the MUS can be transferred to another bus, as shown in step 620. After being transferred to the new bus, the MUS continually queries GPS data to determine if the bus has begun moving, as shown in step 622. When the new bus has begun to move, the MUS proceeds to step 624 where a message is sent to the household and handheld units to indicate that the bus is departing from the accident or breakdown site for pickup.

If in step 614 the bus was determined to have moved more than 0 miles within the past M minutes, the MUS instead proceeds to step 616. In step 616, the MUS queries the distance D that the bus has traveled in the past M minutes. If the distance traveled in the past M minutes is above a predefined threshold of X miles, the MUS presumes that no substantial delay is being incurred, and proceeds to step 626. Otherwise, the bus has traveled more than 0 miles, but less than X miles in the past M minutes, and the MUS therefore presumes that a substantial delay will be incurred due to traffic. If so, the MUS proceeds to step 628 where a notification is sent to the handheld and household units to indicate that a delay will be incurred. In our preferred embodiment, the MUS signal is in the form of text messages transmitted through a mobile telephone network. A message may also be sent to guardians' mobile telephones via text messaging, a recorded audio message, or otherwise. After this message is sent, the MUS proceeds to step 626. Additionally, the school is optionally notified of the potential accident or breakdown via the wireless data link established in step 602.

The MUS next determines whether the bus is nearby any of the designated pickup points, and if so, notifies students associated with such pickup points that their bus is nearing arrival. In step 626, The MUS determines whether the bus is nearby any of the students' pickup points. In the preferred embodiment, this function is realized by measuring the actual distance the bus will need to travel along its route from its current position to reach each pickup point. If the distance that the bus will need to travel along its route to reach a given pickup point is less than a predefined threshold of Y miles, that pickup point is flagged in the MUS as being "nearby." Each distance is calculated by recording the position of the bus with GPS data, and measuring the distance that the bus will need to travel along its route from this point to each pickup point using map data stored within the MUS. In Step 630, the MUS wirelessly signals all household units associated with pickup points which have been flagged as "nearby." This signal activates an alert mechanism on the household units to which it is sent in order to notify students and guardians that the bus will soon arrive. There are many ways to provide such a notification over a mobile telephone network. In the preferred embodiment, the MUS signals the household units by making telephone calls through a mobile telephone network. The calls are made through the same telephone number as the "first call," and the household unit is configured not to answer the call. The household unit will recognize that this is the "second call" originating from this telephone number on the present day, and will associate it with an indication that the bus is nearby. In this way, the system is simplified as one telephone number serves several functions. Additionally, as the telephone call is not answered, minutes are not accrued on the mobile telephone account, and the mobile telephone network bills are generally reduced.

When the bus arrives at a pickup point, the MUS records which students enter the bus. This function is shown in step 632. In the preferred embodiment, a student's arrival on the bus is recorded when the student waves his or her handheld unit 301 in front of the MUS 101. When a handheld unit is waved in front of the MUS, a data signal is transferred from an RFID chip 316 within the handheld unit to an ID scanner such as card reader 172 in the MUS. In this way, the MUS can track the number of students who enter a bus. Additionally, each RFID chip may transmit a unique code associated with a particular student. It should be noted that other embodiments may utilize any appropriate devices to transmit and receive ID codes. For instance, a student may carry an ID card with a magnetic strip which he or she swipes through a card reader installed in the MUS. Alternatively, low power radio frequency transmitters and receivers, RFID tags, ultrasonic transmitters and receivers, or other devices may be used. The MUS associates the unique code with that particular student and records that student's arrival on the bus. When the MUS records that a student has entered the bus as in step 632, a notification is sent to the school through the wireless data link established in step 638. While the preferred embodiment utilizes RFID technology to detect a student's arrival on the bus, it should be noted that many other communication devices can be used to perform this function. For instance, another embodiment may utilize an infrared (IR) communication link, where each handheld unit contains an IR emitter which sends data to an IR receiver in a nearby MUS. In addition to RFID and IR technology, other suitable deices include a radio frequency identification tag, a bar code and bar code reader, and a magnetic stripe card with a magnetic stripe card reader.

After the bus departs from a pickup point, the MUS proceeds to step 634, in this step, the MUS determines whether the bus has visited all of the pickup points. If it has, the MUS proceeds to step 636. Otherwise, the MUS returns to step 614 to continue checking for delays and measuring the distance of the bus to the remaining students.

The MUS next determines whether the bus has arrived back at the school, and optionally notifies the students' guardians when their children are dropped off at school. This functionality is carried out in steps 636 and 638. In step 636, MUS determines if the bus has arrived at the school. The bus is presumed to have arrived at the school if the location of the MUS and bus as recorded from the GPS receiver is nearby the drop-off point at the school. When the bus has arrived at the school, the MUS proceeds to step 638, in which guardians can be optionally notified that their child or children have arrived at the school. In our preferred embodiment, guardians are notified of their child or children's arrival at school via a text message on their mobile phone. In embodiments which include the web service 500, an additional notification may be sent to the web service through a GPRS data link so that guardians may access this notification through a web site on an internet enabled device such as a personal computer. Once the students have been dropped off at school, the morning drop off routine is complete and the MUS unit enters a hibernation mode as shown in step 640.

FIG. 6(*b*) depicts a flowchart to facilitate the functionality of the Main Unit in the School Bus (MUS) when students enter their busses at school and are dropped off at their homes. The process shown in FIG. 6(*b*) commences when the MUS is activated as shown in steps 602 of FIG. 6(*a*). Following activation, the MUS queries the current time in step 604 of FIG. 6(*a*). If the MUS determines that it is not time for the pickup of students, the MUS then proceeds to step 642 of FIG. 6(*b*). In step 642, the MUS queries the current time to determine if it is afternoon. If it is afternoon, the MUS presumes that the bus in which the MUS is located will soon leave the school in order to drop students off at their homes and proceeds to step 644. If it is not afternoon, the MUS presumes that it is not yet time to drop students off at their homes, and accordingly goes into a hibernation state as shown in step 676.

In step 644 of FIG. 6(*b*), the MUS continually queries GPS data to determine if the MUS unit is in motion. If so, the MUS and bus are presumed to be moving together. Motion of the MUS provides an indication that the bus has departed to begin drop off. When motion is detected, the MUS continues to step 646.

In steps 646, 648, 650, 652, 654, 656, and 658 the MUS determines if and why the bus is going to incur a delay, and sends appropriate notifications to guardians, students, and the school. A substantial delay may result from traffic, an accident, or a mechanical breakdown. In our preferred embodiment, the MUS automatically determines whether the bus will be substantially delayed by analyzing the motion of the bus, and additionally assesses the most likely cause of the delay. In our preferred embodiment, the MUS in step 648 queries the distance which the bus has traveled in the past M minutes. If the distance traveled in the past M minutes is very close to or equal to 0, the bus has not been moving, and the source of the delay is most likely an accident or mechanical breakdown. Accordingly, the MUS will presume that a substantial delay will be incurred due to an accident or breakdown. If so, the MUS proceeds to Step 650 and sends notifications to the household units and handheld units to report that the bus will be delayed due to an accident or breakdown. In our preferred embodiment, the MUS signal is in the form of text messages transmitted through a mobile telephone network. A message may also be sent to guardians' mobile telephones via text messaging, a recorded audio message, or otherwise. In the case of an accident, the MUS can be transferred to another bus, as shown in step 652. After being transferred to the new bus, the MUS continually queries GPS data to determine if the bus has begun moving, as shown in step 654. When the new bus has begun to move, the MUS proceeds to step 656 where a text message is optionally sent to the guardians' mobile telephones to indicate that the bus is departing from the accident or breakdown site for pickup.

If in step 646 the bus was determined to have moved more than 0 miles within the past M minutes, the MUS instead proceeds to step 648. In step 648, the MUS queries the distance D that the bus has traveled in the past M minutes. If the distance traveled in the past M minutes is above a predefined threshold of X miles, the MUS presumes that no substantial delay is being incurred, and proceeds to step 662. Otherwise, the bus has traveled more than 0 miles, but less than X miles in the past M minutes, and the MUS therefore presumes that a substantial delay will be incurred due to traffic. If so, the MUS proceeds to step 658 where a notification is sent to the handheld and household units to indicate that a delay will be incurred. In our preferred embodiment, the MUS signal is in the form of text messages transmitted through a mobile telephone network. A message may also be sent to guardians' mobile telephones via text messaging, a recorded audio message, or otherwise. After this message is sent, the MUS proceeds to step 662. Additionally, the school is optionally notified of the potential accident or breakdown a wireless data link established in step 602 or step 670.

The MUS next determines whether the bus is nearby any of the designated drop off points, and if so, notifies guardians associated with such drop-off points that their child/children will arrive soon and will need to be pickup up. In step 662, The MUS determines whether the bus is nearby any of the students' drop-off points. In the preferred embodiment, this function is realized by measuring the actual distance the bus will need to travel along its route from its current position to reach each drop off point. If the distance that the bus will need to travel along its route to reach a given drop off point is less than a predefined distance of X miles, that drop off point is flagged in the MUS as being "nearby." Each distance is calculated by recording the position of the bus with GPS data, and measuring the distance that the bus will need to travel along its route from this point to each drop off point using map data stored within the MUS. In Step 664, the MUS calls all household units associated with drop off points which have been flagged as "nearby." This call alerts guardians their child/children will soon arrive and may need to be pickup up.

There are many ways to provide such a notification over a telephone network. In our preferred embodiment, the call is made through a designated phone number. The household unit will recognize that this is the "second call" originating from this telephone number on the present afternoon, and will associate it with an indication that the bus is nearby. In this way, the system is simplified as one telephone number serves several functions. Additionally, as the telephone call is not answered, minutes are not accrued on the mobile telephone account, and the telephone bills are generally reduced.

When the bus arrives at a drop-off point, the MUS records which students depart from the bus. This function is shown in step 666. When the MUS records that a student has departed from the bus, a notification may optionally be sent to the school through the wireless data link established in step 602 or step 670. A student's departure from the bus is recorded when the student waves his or her handheld unit 301 in front of the MUS 101. When a handheld unit is waved in front of the MUS, a data signal is transferred from an RFID chip 316 within the handheld unit to an RFID receiver in the MUS. This data transfer can be accomplished in many ways, such as the use of a magnetic strip, bar code, or infra ray. In this way, the MUS can track the number of students who depart from a bus. Additionally, each RFID chip may transmit a unique code associated with a particular student. The MUS associates the unique code with that particular student and records that student's departure from the bus. After the MUS records that a student has entered the bus, a notification is sent to the school through the wireless data link established in step 638 or step 670. While the preferred embodiment utilizes RFID technology to detect a student's departure from a bus, it should be noted that many other communication devices can be used to perform this function. For instance, another embodiment may utilize an infrared (IR) communication link, where each handheld unit contains an IR emitter which sends data to an IR receiver in a nearby MUS. In addition to RFID and IR technology, other suitable deices include a radio frequency identification tag, a bar code and bar code reader, and a magnetic stripe card with a magnetic stripe card reader.

After a student has departed from the bus, the MUS proceeds to step 668, to determine whether the bus has visited all of the designated drop off points. If it has, the MUS proceeds to step 670. Otherwise, the MUS returns to step 662 to continue checking for delays and measuring the distance of the bus to the remaining drop off points.

Step 670, provides a method for notifying guardians if and when their children have been dropped off. In our preferred embodiment, The MUS sends notifications to the web service shown in FIG. 5 through a GPRS data link. Guardians can access the notifications through a web site on an Internet enabled device such as a personal computer. These notifications can optionally be sent to guardians' mobile telephones in the form of text messages. Once the bus has visited all of the designated drop off points, the MUS stays active for ten additional minutes as shown in step 672 and afterwards enters hibernation mode as shown in step 674.

Figure 2:
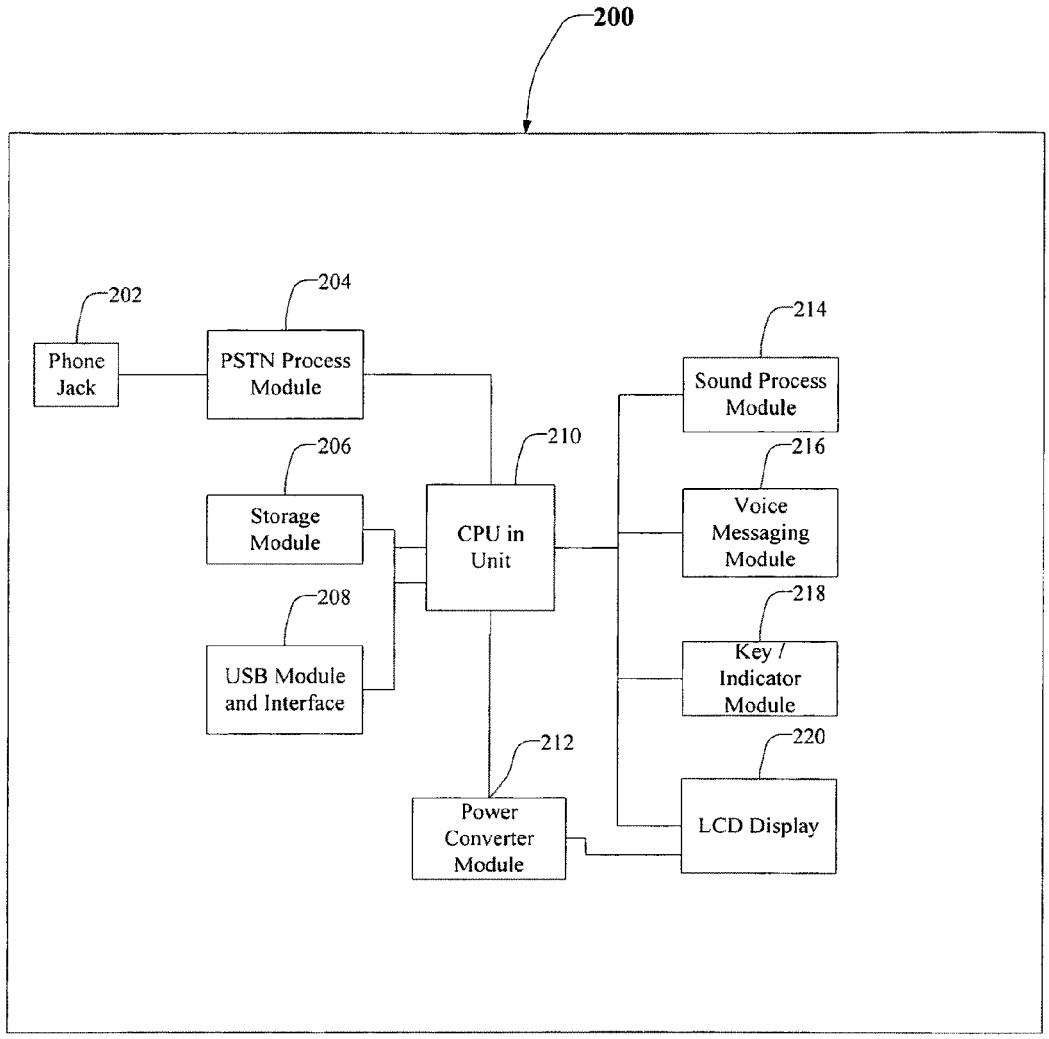
FIG. 2 is a block diagram of the household unit.

Referring now to FIG. 2, the preferred embodiment of the present invention additionally includes household units 201 located in the homes of the students on a school's bus route. Each household unit contains a means for connecting to a telephone network through which notifications are sent and received. A household unit can receive and/or send notifications through various types of mobile and land based telephone networks. However, the preferred embodiment utilizes a land based telephone network in order to keep telephone network costs as low as possible. Each household unit in the preferred embodiment contains a telephone jack 202 to connect to a land based telephone network. The phone jack 202 connects to a process module 204. The Public Switched Telephone Network (PSTN) process module 204 contains the necessary circuitry to send and receive calls on a landline telephone network and to transfer call data to the CPU 210 within the household unit. The home phone process module 204 further includes caller identification functionality to determine the phone number from which an incoming call originates. Process module 204 can also function as 'modem' to call computer server to download data such as schedule automatically.

Figure 7:
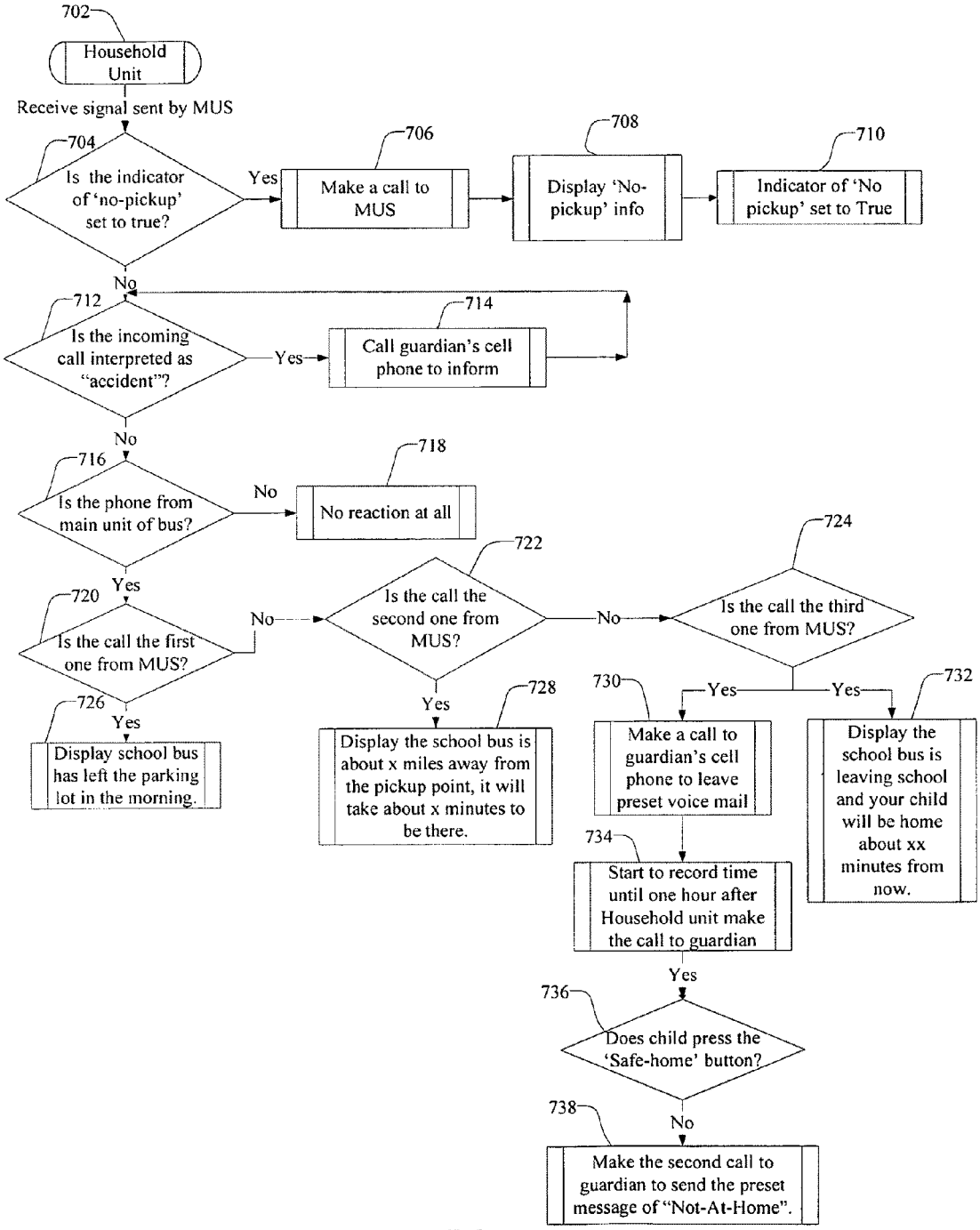
FIG. 7 is a flowchart to facilitate the functionality of the household unit.

The household units are capable of receiving several types of notifications. For example, the household unit notifies members of a household of the impending arrival of a bus, or of a delay. To this end, the household units of the preferred embodiment of the household unit contain both visual and audio means of notifying members of the household of events, as shown in FIG. 7 and the description thereof. To provide visual notifications, the household units include a Liquid Crystal Display (LCD) 220. Audio notifications are implemented with a sound process module 214, which contains a speaker, audio amplifier, and any additional circuitry which may be needed to interface to the CPU 210. Additionally, a voice message module 216 can speak the content of a message using a simulated or recorded voice.

While there are many acceptable means to provide electrical power to the various components of the household units, the preferred embodiment contains a power converter module 212. The power converter module 212 contains a connector for receiving power from an external power supply. The power converter module 212 further contains any circuitry as may be needed to convert the power received through the previously mentioned connector to appropriate voltages needed to power the components within the household unit.

Each household unit further contains a means for changing various configuration data and/or settings. There are many possible configuration data and/or settings that might be included in various embodiments of the invention. In the preferred embodiment, one such set of configuration data are the phone numbers of the MUS in the bus assigned to a particular household unit. In our preferred embodiment, configuration data and/or settings can be changed through a USB (Universal Serial Bus) module interface 208. The USB module interface contains a USB connector and the necessary circuitry to implement a USB connection. The USB connector is used to connect a configuration device to the household unit. The configuration device may be a personal computer or any other USB capable device from which configuration settings can be transferred to the household unit.

The household unit has a key/indicator module 218. The user interface module 218 contains three buttons: a no pickup button, an arrival button, and a repeat message button. A member of a household may press the no pickup button to alert the bus that a student associated with that household does not desire to be picked up on a given day. When the no pickup button has been pressed, the no pickup LED 224 of FIG. 3 will illuminate. A student depresses the arrival button upon arriving home after being dropped off by their bus to indicate that they arrived home safely. When the arrival button has been depressed, the arrival LED 230 of FIG. 3 will illuminate. The repeat button will display a previous message. As shown in FIG. 2, process module 204 acts as 'modem' to dialup automatically to school computer servers to download the stream-data directly from phone line and then translate into certain format and display the data on the LCD screen. The calendar is built-in so that when the first time the receiver receives the information, it will display on the screen. When the event or activity will happen in next day, it will activate again to prompt the information again to inform of parents. Schools and teachers utilize this function to send information to parents without wasting paper unless the information needs to be signed by parents. Also teachers can select a certain group to receive the information relevant to them.

Each household unit of the preferred embodiment finally contains a CPU 210 which controls the various devices within the household unit and implements a method of notifying guardians, students, and other interested parties, as shown in FIG. 7 and the explained in the description thereof. The CPU 210 is interfaced to a storage module 206 which contains memory to store various data, which may include configuration information.

FIG. 4(*b*) shows a schematic drawing 200 of the household unit 201. The household unit contains buttons 222, 226, and 228 which may be activated by members of the household. The no pickup button 222 may be depressed when bus pickup is not desired on a given day. If depressed, the household unit will send a no pickup notification to the MUS in the student's or students' bus as shown in FIG. 7 and the explained in the description thereof. Depressing the no pickup button 222 will cause no pickup indicator LED (Light Emitting Diode) 224 to illuminate, thereby alerting members of a household that the no pickup function has been activated. The household units also contain an arrival button 228 which students may depress after they are dropped off and return back home safely. When the arrival button is depressed, the household unit will optionally send notifications to the student or students' guardians as shown in FIG. 7 and explained in the description thereof. Depressing the arrival button 228 will cause arrival indicator LED (Light Emitting Diode) 230 to illuminate, thereby providing a signal that the no pickup function has been activated. Depressing the no pickup button 222 will cause the no pickup indicator LED 224 to illuminate, thereby indicating that the no pickup function has been activated. Finally, the household unit contains a re-view notification button 226. Pressing the re-view notification button 226 causes the household unit to display previous notification messages on the LCD display 220.

Also shown in FIG. 4(*b*) are illustrations of several previously mentioned components of the household unit 201. The LCD display 220 to display notifications and messages and the voice messaging module 216 to provide audio tone alerts and to speak out messages. The telephone jack 202 is located on the top of the device, and provides a means to connect the household unit to a land based telephone network. The household unit receives electrical power through power connector 212. In the preferred embodiment, a 6 volt, alternating current external power supply connects to power connector 212. The USB connector portion of the USB interface module 208 allows the household unit to connect to external device in order to change configuration settings.

FIG. 7 depicts a flowchart to facilitate the functionality of the household unit. The flowchart illustrates how the household unit receives, processes, and displays notifications originating from an MUS, and how the household unit can be used to inform the bus driver that a student does not wish to be pickup up.

In step 702, the household unit waits until a wireless notification is received from the MUS. The first notification that the household unit will receive during the pickup or drop off of students is an indication that the bus has departed from the school bus parking lot. In the preferred embodiment, this notification is carried out through a mobile telephone network using caller identification functionality. The household unit identifies whether an incoming call has originated from a number assigned to an MUS, and ignores it otherwise. If the call does indeed originate from the MUS assigned to the route, the household unit proceeds to step 704.

In steps 704, 706, 708, and 710, the household unit queries whether the students in the household in which the unit is located wish to have the school bus pick them up, and transmits this information to the MUS so that the bus does not need make unnecessary stops. In step 704, the household unit checks to see if the no pickup button, 222 of FIG. 4(*b*), on the front panel of the unit has been activated. If nobody in the household has activated this button, the students are presumed to desire to be picked up by the school bus, and the household unit proceeds to step 712. If the no pickup button 222 has been activated, the household unit notifies the bus driver by making a telephone call to the MUS as shown in step 706. The home unit does not wait for the call to be answered by the MUS, as the MUS will infer the purpose of the call and determine the home unit from which it originates by means of caller identification as described in FIG. 6 and the description thereof. Finally, the household unit will activate the no pickup indicator LED 224 on the front panel of the unit to confirm that the bus will not pick up the students, as shown in step 708. In step 710, an internal flag will be set to indicate that pickup is not desired on the present day.

Next, in step 712, the household unit will check if the incoming call from the MUS indicates that the bus was involved in an accident or is delayed due to a mechanical breakdown. The call will be interpreted as such if it originates from a phone number designated for the purpose of indicating an accident or delay. In this way the household unit acquires the meaning of the call through caller identification functionality. As the call does not need to be answered, telephone network charges are kept to a minimum. If the call does indicate an accident or delay, the household unit, in step 714, will notify the guardian by sending a text message to the guardian's mobile telephone. If the incoming call from the MUS does not indicate that there was an accident or mechanical breakdown, the household unit will proceed to step 716.

In step 716, the household unit checks to see if the incoming call originated from the MUS associated with the bus picking up the students assigned to this household unit. The household unit makes this determination by comparing the telephone number of the incoming call derived form caller identification data to a stored list of numbers associated with the MUS. If the call did not originate from the MUS, the household unit ignores the call, as shown in step 718. If the call did originate from the MUS, the household unit proceeds to step 720 to determine the meaning of the call.

In steps 720, 722, and 724, the household unit determines the meaning of the incoming call from the MUS by the order in which the calls were received. In this way, a call originating from a single telephone number can provide several different notifications, still without requiring the call to be answered. In step 720, the household unit determines whether the call is the first call received from the MUS in the morning from a preset list of numbers. If so, the household unit infers that the call was sent to indicate that the bus has left the school to pick up students and proceeds to step 726 where this notification is displayed on the LCD display 220 located on the front panel of the household unit. If it is not the first call received from the MUS, the household unit proceeds to step 722 and determines whether it is the second call from the preset list of numbers during the present day. If so, the call indicated that the bus is within a preset distance of Y miles from the pickup point. The household unit in step 728 accordingly displays an estimated arrival time of the bus. If the call was not the second call received, the household unit proceeds to step 724.

In step 724, the household unit determines whether the call is the third call received from the MUS on the present day. If it is, the household unit presumes this call means that the bus has left the school to drop students off, and the household unit accordingly, in step 732 displays an estimate of when the student or students assigned to the household unit will arrive home. Additionally, the household unit will proceed to step 730, where a call will optionally be made to a guardian's phone to provide a notification that their child is being dropped off. In the preferred embodiment, this notification is a prerecorded voicemail that is left on the guardians' mobile telephone. However, other embodiments may use other notification methods such as text messaging. The household unit will then proceed to step 734 where the household unit will simply wait for a preset time period, such as one hour, and then proceed to step 736. In step 736, the household unit will check to see if the student has pressed the arrival button 228 on the household unit to indicate that they have arrived back at home. If the student did not press this button, it is possible that the student did not arrive safely at home, and the household unit accordingly places another call to the guardian to alert the guardian that their student is not at home, as shown in step 738.

The preferred embodiment further contains handheld units for providing notifications to students and for tracking when students enter and leave a bus. Like a household unit, a handheld unit provides notifications to a student about an arriving bus, and also of delays and accidents. However, unlike the household unit which is intended to be kept in a household, the handheld unit is portable and is designed to be carried by students. A schematic of the handheld unit 301 of the preferred embodiment is shown in FIG. 4(*c*). However, the shape and size of the household unit may be different in other embodiments of the present invention. A student carrying a handheld unit receives notifications via a display screen 312 on the front of the device. A student may display messages, delete messages, or perform other functions through keypad 308. As the handheld unit is intended to be carried by students, it requires a wireless means of receiving notifications. To do so, our preferred embodiment utilizes a mobile telephone network. The mobile telephone network is accessed through antenna 302. In addition, the handheld unit in conjunction with the MUSs can be used to track when students enter and leave a bus. To this end, the handheld unit contains a short range data link which sends data to a short range data link in an MUS. In our preferred embodiment, this short range data link is a Radio Frequency Identification Device (RFID). Each handheld unit contains an RFID chip 316 which holds a unique identification code. Each MUS contains a receiving device capable of reading codes from an RFID chip. A student entering or leaving a bus may simply wave their handheld unit in front of the MUS to register their arrival or departure. It should be understood that other data transfer means may be used in place of RFID devices. For instance, bar codes, Infra Red (IR) emitters and detectors, the Bluetooth wireless protocol, or wireless USB, or GPRS may be used to provide similar functionality in other embodiments.

Figure 3:
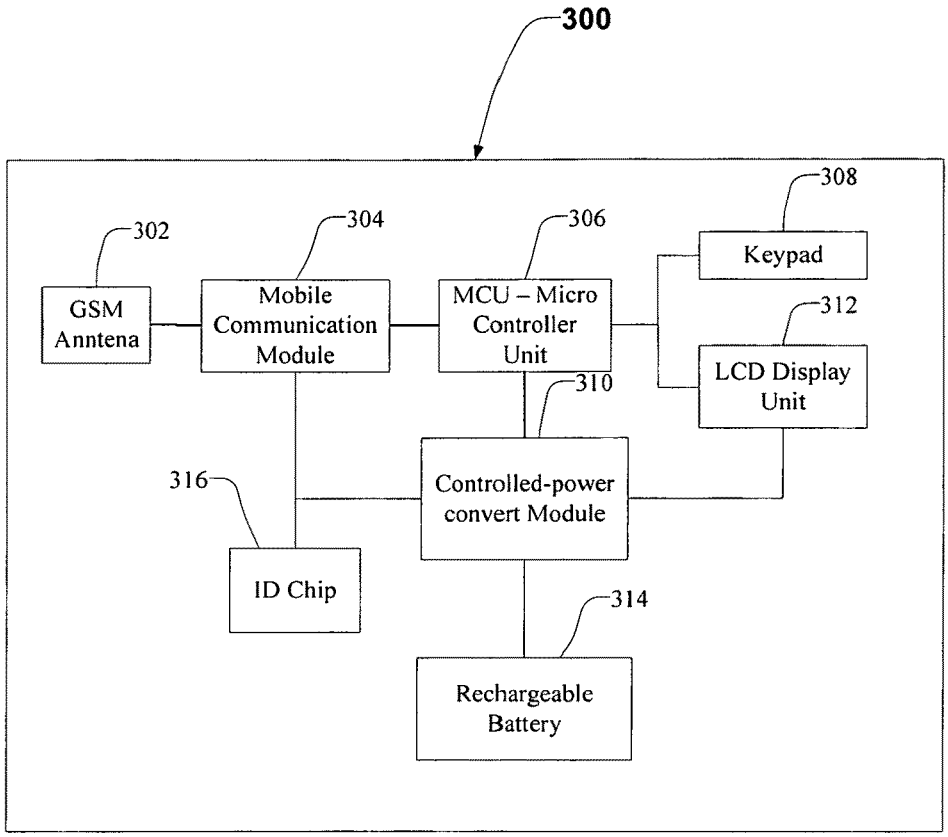
FIG. 3 is a block diagram of the handheld unit.

A block diagram 300 showing the functions of handheld device 301 is shown in FIG. 3. Each household unit in the preferred embodiment contains a mobile communications module 304 and antenna 302 to connect to a mobile telephone network. We use the term mobile telephone module simply to refer to the electronic circuitry used to implement the sending and receiving of calls through a single telephone number on the GSM or other mobile telephone network. One or more mobile communication modules 304 may also contain circuitry to implement further functions, such as calling number identification, data transfer though the GPRS mobile data service, and the transfer of text messages through the Short Message Service (SMS). While the mobile telephone modules 304 may be implemented in many ways, those of the preferred embodiment comprise a GSM transmission module and an associated power converter, and a microcontroller and its associated power converter. The handheld units are capable of receiving several types of notifications. To provide visual notifications, the handheld units include a Liquid Crystal Display (LCD) 312. For example, the LCD 312 may display text messages received through a mobile phone network which originated from a MUS. In order to receive inputs from users, the handheld units have a portable function keypad 308. The portable function keypad 308 allow a user to activate several functions such as displaying messages and deleting messages.

While there are many acceptable means to provide electrical power to the various components of a handheld unit, the preferred embodiment utilizes an internal rechargeable battery 314 and a power converter module 310. The rechargeable battery 314 may contain one or multiple cells. The power converter module 310 contains any circuitry as may be needed to convert the power received through the previously mentioned connector to appropriate voltages needed to power the components within the handheld unit.

Each handheld unit of the preferred embodiment finally contains a Micro Controller Unit (MCU) 306 which controls the various devices within the handheld unit and implements a method of notifying guardians, students, and other interested parties, as shown in FIG. 7 and the explained in the description thereof. The MCU 306 contains a CPU and memory.

FIG. 5 is a schematic diagram of the worldwide web service 500 (web service). The web service is an optional system which supplements or replaces some or all of the notification functions which are performed by telephone networks in the preferred embodiment. More specifically, the web service enables users, who may be guardians, students, or other interested parties to access via the Internet a web page containing notifications. The users may access this notification web page conveniently through their home personal computer, an Internet enabled mobile telephone, or any other suitable means for connecting to the Internet. Many types of notifications could be displayed on the web page. Some examples include whether a student was dropped off, what time students where dropped off at home or at school, the expected arrival times of busses, and expected delays. Furthermore, in other embodiments, users such as students or guardians may additionally send notifications to the school or busses through the web service.

A web service as described may be implemented in many ways. In the preferred embodiment, the web service comprises a database server 502 and a web server 504. The database server 502 provides memory wherein various data is stored. The web server 504 provides a means of accepting communication requests from web browsers through the Internet, and of responding with a HyperText Markup Language (HTML) document or other type of document. Data is transferred from the web server 504 and/or database server 502 to the MUS 101 and users' personal computers through the Internet. Such data is directed to and from the components within the Internet by means of router 506. The router 506 is an integral part of the Internet. Database server 502 can send streamed data to household receiver by using the same system. These streamed data can be school calendar, school notice, class programs etc.

Since the status of each bus and student is gathered in each MUS, the web service requires a means of accessing this data from each MUS. To do so, data can be transferred from the MUSs to the web service in several possible ways. However, our preferred embodiment utilizes the GPRS system which enables data to be received wirelessly from the MUS 101 in each school bus. The web service receives GPRS signals through antenna 152.

Although the invention as been described with reference to certain preferred embodiments, it will be appreciated by those skilled in the art that modifications and variations may be made without departing from the spirit and scope of the invention. It should be understood that applicant does not intend to be limited to the particular details described above and illustrated in the accompanying drawings. In this regard, the term "means for" as used in the claims is intended to include not only the designs illustrated in the drawings of this application and the equivalent designs discussed in the text, but it is also intended to cover other equivalents now known to those skilled in the art, or those equivalents which may become known to those skilled in the art in the future.

What is claimed is:

1. A transportation notification system comprising:

at least one vehicle for transporting people as passengers;

a transceiver unit within said at least vehicle comprising a wireless communication means wherein said wireless communication means within said transceiver unit is at least one connection to a mobile telephone network, wherein said connection to said mobile telephone network comprises at least one removable mobile telephone network module;

wherein said at least one removable mobile telephone network module contains an electrical connector means to accept electrical power and signals;

wherein said transceiver unit further comprises a plurality of expansion slots dimensioned to accept said at least one removable mobile telephone network module;

wherein said slots comprise a second electrical connector means dimensioned to accept a first electrical connector means;

whereby a desired number of said removable mobile telephone network modules may be added and removed from said transceiver unit to adjust the amount of said data that said transceiver unit is capable of transferring, a satellite navigation system receiver to acquire the location of said at least one vehicle, a memory storage device for storing map and vehicle route information, at least one display means for presenting information to a vehicle driver, and at least one Central Processing Unit (CPU) interfaced to said memory storage device, to said wireless communication means, and to said satellite navigation system receiver, wherein said transceiver unit transfers data regarding a location of said at least one vehicle relative to a plurality of passenger pick-up and drop-off locations;

a plurality of household units located proximate to said pick-up and drop-off locations comprising at least one means for sending and receiving data regarding passenger status and said vehicles impending arrival at said pick-up and drop-off locations, at least one display means, and at least one CPU controllably interfaced to said means for sending and receiving data and to display means.

2. The transportation notification system of claim 1, wherein said at least one display means within said transceiver unit comprises an array of indicators visible to the vehicle driver, wherein each of said indicators are associated with the status of one of said people, the array of indicators is interfaced to the CPU within the transceiver unit.

3. The transportation notification system of claim 2, wherein each of said household units further comprises a user interface means to notify the vehicle driver through said array of indicators that at least one of said people at a specific said pick-up location does not need to be picked up.

4. The transportation notification system of claim 1 wherein said data is transferred through telephone calls on a telephone network utilizing caller identification and where the need to answer said telephone calls is eliminated:

wherein at least one of said means for sending and receiving information within at least one of said household units is a telephone network;

wherein at least one of said household units further comprise a caller identification means to determine the telephone number of an incoming call received through said telephone network during a ring signal, wherein said telephone number is identified without said incoming call being answered;

wherein at least one of said household units further comprises a memory storage device containing a lookup table comprising known telephone numbers and meanings associated with them, whereby the household unit can receive and identify a notification from one of said transceiver units through a telephone call without answering the telephone call.

5. A transportation notification system utilizing a web service to allow system users to access notifications through the Internet, comprising:

at least one vehicle for transporting people as passengers;

a transceiver unit within said at least vehicle comprising a wireless communication means, a satellite navigation system receiver to acquire the location of said at least one vehicle, a memory storage device for storing map and vehicle route information, at least one display means for presenting information to a vehicle driver, and at least one Central Processing Unit (CPU) interfaced to said memory storage device, to said wireless communication means, and to said satellite navigation system receiver, wherein said transceiver unit transfers data regarding a location of said at least one vehicle relative to a plurality of passenger pick-up and drop-off locations;

a plurality of Internet connected devices, each having a display means capable of displaying a plurality of notifications; and a web server having a connection to the Internet to receive data from said transceiver units and send notifications over the Internet to said Internet connected devices and said web server further comprises a display for showing vehicle fleet data comprising the location of said at least one vehicle.

6. The transportation notification system of claim 5 wherein said wireless communication means in said transceiver unit is at least one General Packet Radio Service (GPRS) capable mobile telephone communication module, said web server further comprises at least one GPRS mobile telephone communication module, wherein said transceiver unit transmits data comprising notifications to said web server using said at least one GPRS capable mobile telephone communication module, wherein said notifications are sent to interested parties through said connection to the Internet.

7. A transportation notification method comprising steps of:

acquiring the location of at least one vehicle by receiving signals from at least one satellite in a satellite navigation system;

deriving the distance that the vehicle must travel to reach various destinations by comparing a vehicle location to stored route information, stored map information, and stored locations of destinations;

determining if the vehicle is nearby said designated destinations by calculating which if any of said distances are below a predefined threshold;

notifying parties of at least one type of situation including the impending arrival of a vehicle;

receiving said notification signals at a plurality of household devices located within a plurality of residences;

providing a user interface in each of said household devices for a person to activate when said person does not desire to be picked up by a vehicle;

querying said user interface in each of said household units to determine if it has been activated;

generating at least one no pickup notification for each household unit in which said user interface has been activated;

sending said at least one no pickup notification wirelessly to said at least one vehicle;

providing a display within said at least one vehicle viewable by the driver of said at least one vehicle;

showing which of said persons do not desire to be picked up on said display.

8. The method of claim 7, further comprising:

querying the current time;

presuming that the vehicles are picking up people from designated pickup points if said time is in the morning;

presuming that the vehicles are dropping people off at designated dropoff points if said time is in the afternoon.

9. The method of claim 7, wherein the step of notifying parties comprises:

providing a memory which is able to store a look up table;

storing a list of at least one telephone number in said look up table;

storing a list of at least one notification in said lookup table, wherein each of said at least one notification is associated with one of said at least on telephone number;

receiving a telephone call from a number belonging to said list of at least one telephone number;

leaving said telephone call unanswered;

identifying the phone number from which the call has originated via a caller identification means;

determining said notification associated with said look up table;

generating a notification by outputting the notification associated with the identified telephone number.

10. The method of claim 9, wherein said step of determining notification associated with said look up table in which a meaning of a notification sent through a telephone network can be determined without answering said telephone call; and in which a plurality of different notifications can be sent through a single telephone number, wherein the said step of determining the meaning of the notification comprises:

providing a memory which is able to store the lookup table;

storing the lookup table in said memory which contains telephone numbers and the number of calls previously made through each telephone number during a single day, and an a meaning associated with each permutation of stored telephone numbers and the number of calls made through each telephone number during a day;

comparing the incoming telephone number and the number of calls previously received from the incoming telephone number during the current day to the list of numbers in the said lookup table; and acquiring the meaning associated with the incoming telephone number and the number of calls made through the said number during the current day from their associated meanings stored in the lookup table.

11. The method of claim 9 in which the meaning of a notification sent through a telephone network can be determined without answering said telephone call, and in which a plurality of different notifications can be sent through a single telephone number, wherein the said step of determining the meaning of the notification comprises:

providing the memory which is able to store the lookup table;

storing the lookup table in said memory which contains telephone numbers and at least one timeframe when each telephone number may be received;

assigning unique notification meaning to each permutation of said telephone numbers and timeframes;

storing said meanings in the lookup table;

recording the time in which a telephone call was received;

determining which timeframe in the lookup table associated with the received telephone call the said recorded time falls within;

acquiring the meaning associated with the incoming telephone number and time in which it was received from the several meanings stored in the lookup table.

12. The method of claim 7, wherein the step of notifying parties includes:

providing a memory which is able to store a lookup table, said lookup table containing telephone numbers and an associated notification meaning associated with each telephone number;

comparing an incoming telephone number to the numbers in said lookup table; and acquiring the meaning associated with the incoming telephone number from the meaning stored in the lookup table.

13. A transportation notification system comprising:

at least one vehicle for transporting people as passengers;

a transceiver unit within said at least one vehicle comprising a wireless communication means including at least one removable mobile telephone network module, a satellite navigation system receiver to acquire a location of said at least one vehicle, a memory storage device for storing map and vehicle route information, at least one display means for presenting information to a driver of said at least one vehicle comprising an array of indicators, each said indicator associated with the status of one of said people, an identification device reader to record a unique identification code when at least one of said passengers enters and departs said at least one vehicle, and at least one Central Processing Unit (CPU) interfaced to said memory storage device, to said wireless communication means, to said satellite navigation system receiver, and to said identification device reader, wherein said transceiver unit transfers data regarding a location of said at least one vehicle relative to a plurality of passenger pick-up and drop-off locations;

a plurality of household units located proximate to said pick-up and drop-off locations comprising at least one means for sending and receiving data regarding passenger status and said vehicles' impending arrival at said pick-up and drop-off locations, at least one display means, a user interface means to notify a driver of said at least one vehicles through said array of indicators that at least one of said people at a specific said pick-up location does not need to be picked up, and at least one CPU controllably interfaced to said means for sending and receiving data, said display means, and said user interface means;

a plurality of handheld units, said handheld units comprising at least one wireless communication means for sending and receiving data including passenger status and said vehicles' impending arrival at said pick-up and drop-off locations, a display means, at least one identification device to transfer a unique identification code to said transceiver unit when at least one of said passengers enter and depart said at least one vehicle, and at least one CPU controllably interfaced to said means of transferring information wirelessly, to said display means, and to said identification device reader, wherein the handheld units are portable and carried by at least one of said people;

a plurality of Internet connected devices, each having a display means capable of displaying a plurality of notifications; and a web server to receive data from said transceiver units and send notifications over the Internet to said Internet connected devices.

* * * * *